United States Patent [19]

van Uitert

[11] Patent Number: 4,835,836

[45] Date of Patent: Jun. 6, 1989

[54] DEVICE FOR THE CUTTING AND REMOVAL OF THE STRAPPING BANDS FROM AN OBJECT

[76] Inventor: Johannes H. van Uitert, Vaartweg 33, 5109 RB 's-Gravenmoer, Netherlands

[21] Appl. No.: 139,794

[22] Filed: Dec. 30, 1987

[51] Int. Cl.[4] ..... B23P 19/00; B65B 69/00

[52] U.S. Cl. ..... 29/564.3; 83/156; 83/909; 83/923; 241/101.2; 241/DIG. 38

[58] Field of Search ..... 83/365, 370, 909, 279, 83/156, 923; 29/564.3, 426.4; 241/224, 225, 101.2, 101.5, 30, 152 A, DIG. 38

[56] References Cited

U.S. PATENT DOCUMENTS

| | | | |
|---|---|---|---|
| 2,735,540 | 2/1956 | Gibson et al. | 83/279 |
| 2,820,282 | 1/1958 | Schneider, Jr. | 29/564.3 |
| 3,513,522 | 5/1970 | Thomson | 83/909 X |
| 4,219,914 | 9/1980 | Bartzick et al. | 83/909 X |
| 4,437,223 | 3/1984 | Petros | 29/564.3 |
| 4,660,818 | 4/1987 | Conner et al. | 83/909 X |
| 4,718,157 | 1/1988 | Keyzers et al. | 83/909 X |

*Primary Examiner*—Frank T. Yost
*Assistant Examiner*—Hien H. Phan
*Attorney, Agent, or Firm*—Dennis H. Lambert

[57] ABSTRACT

A device for cutting and removal of the strapping bands from an object, said device comprising a framework adapted to be placed over a conveying track for supplying the object to the device, said framework being provided with supports for at least one clamping-cutting-means, which is supported in such a way that it is movable with respect to at least one wall of the object to search for a strapping band lying against said wall, said band being clamped by the means and cut off, after which the cut off end is brought to a band receiving station by the clamping-cutting-means.

14 Claims, 5 Drawing Sheets

DEVICE FOR THE CUTTING AND REMOVAL OF THE STRAPPING BANDS FROM AN OBJECT

FIELD OF THE INVENTION

The invention relates to a device for cutting and removal of the strapping bands from an object, said device comprising a framework adapted to be placed over a conveying track for supplying the object to the device, said framework being provided with supports movable in respect of said frame and carrying means for gathering, cuting and removal of said bands.

PRIOR ART

Such a device is disclosed in U.S. Pat. No. 3,513,522. This known device is in particular suitable for removing strapping bands from bales of hay and comprises a first vertically movable cutter frame which carries the cutting means and is positioned transversely with respect to the supply direction of the bales and a second vertically movable frame which carries gathering hooks or jaws. The cutting means are in the form of three pairs of shearing blades, one pair for each of the tie bands which longitudinally encircle the hay bale. The jaws cooperate to gather together the three severed tie bands so that they can be wound around a rotating reel.

Since this known device is only suitable for cutting and gathering bands which longitudinally encircle an object, the bands have to be applied in a vertical plane which has to run in the supply direction of an object.

Further, the removed bands have to be wound around a shaft, after which the shaft is longitudinally moved, after which the wound bundle of bands is wiped from the shaft, dropped into a conveying trough and conveyed by a power conveyor belt to a trash barrel.

This known device is rather complicated and is only suitable for removing a given number of bands which are applied in a given direction around an object. Further, the bands have to be suitable for being wound around the shaft to be removed in the described way.

SUMMARY OF THE INVENTION

Accordingly, an object of the invention is to improve the known device such that it is suitable for removal of strapping bands which are applied around an object in various directions and in various numbers, while the bands can be made of materials with different properties.

According to the present invention, the device comprises at least one clamping-cutting-means, which is supported in such a way that it is movable with respect to at least one wall of the object to search for a strapping band lying against said wall, which band is clamped by the means and then is cut off, after which the cut off end, by moving said means, is brought to a fixedly positioned band receiving station by which the band is gathered and removed. In this way, each band present on the relating wall of the object can be removed by the device and positively fed to the band receiving station so that it does not matter how many bands are applied on the object.

The device according to the present invention in particular can be used for removing strapping bands from a pallet on which objects have been placed for transportation. In many cases, a frame of angle steel is applied onto such a load, said angle steel being fixedly connected to the pallet by means of said strapping bands. The strapping bands can consist of either rope, plastic or metal.

According to an embodiment of the invention, it can be provided that the clamping-cutting-means is rotatably connected to a support element which in its turn is movable in three mutually perpendicular directions, two of which lie in the same plane as the plane in which the clamping-cutting-means is rotatable. In this way, the clamping-cutting-means can first be brought towards the place in which one or more strapping bands are present. In practice, strapping bands are often applied at 90° with respect to each other and by rotating the clamping-cutting-means, mutually perpendicular bands can also be severed and removed.

According to a preferred embodiment of the invention, the device comprises a first horizontal support beam running transversely to the supply direction of an object, along which beam a second horizontal support beam is movable and which extends in the direction of supply of an object, along which second beam the support element is movable carrying the clamping-cutting-means.

In such a device, the first support beam can be moved downwardly to an object which has stopped below the device till the first support beam is arrived at the desired height, after which by moving the second support beam and/or moving the support element along the second support beam, the clamping-cutting-means connected to the support element can be brought into proximity with a strapping band. In such a case, the position of the first support beam is ascertained by the height of the object and then the strapping bands, extending themselves over the top of the object, are searched for.

Obviously, it is also possible to rotate the whole system such that the first and second support beams are brought into a vertical plane so that the clamping-cutting-means can come into engagement with those portions of the strapping bands extending in a substantially vertical direction along a vertical wall of the object. In that case, however, a side wall as well as a front or rear wall of the object, as seen in the supply direction of the object, will be searched for strapping bands, when the strapping bands are crosswise applied around the object.

In the first described case, only the top side or the object has to be searched so that such an embodiment, generally speaking, will be preferred.

It is preferred that the support element be operated such that the clamping-cutting-means can be brought into two positions which are turned over 90° in respect of each other. Generally speaking, this will be sufficient to seize all strapping bands one after each other, to cut and to remove them.

According to the invention, the clamping-cutting-means comprises a set of clamping jaws which can seize a strapping band, and a set of cutting jaws which can sever the strapping band beside the portion which is clamped by means of the clamping jaws, means being present to activate the clamping jaws and the cutting jaws one after the other.

In particular, the clamping-cutting-means will be provided with a guide wheel which can cooperate with a part of the object. This part can be a frame which is present on the load which has been brought onto a pallet as described above.

Controlling the clamping-cutting-means may take place by means of photo-electric cells. In a way described hereafter, these cells can observe or detect when a strapping band is present between the clamping jaws, after which this strapping band is clamped and thereafter cut off by the cutting jaws.

The clamping jaws will supply the cut-off band to a band receiving station in which the band is pulled in and then is shredded, granulated or reduced to smaller pieces in one way or another. The small pieces of material or granules, e.g., can be removed by means of a hose or can be received directly in a bag so that it is possible to remove the band in an easy way.

Movement of the clamping-cutting-means, activating the clamping and cutting jaws and supplying the end of a severed band to the shredder or granulator, generally speaking, will take place by means of cylinders and by pressurized medium controlled by a relay or printed logic circuit (PLC) control.

BRIEF DESCRIPTION OF THE DRAWINGS

These and other objects and advantages of the invention will become apparent from the following detailed description when taken in conjunction with the drawings, in which like reference characters designate like parts throughout the several views, and wherein.

Figure 1:
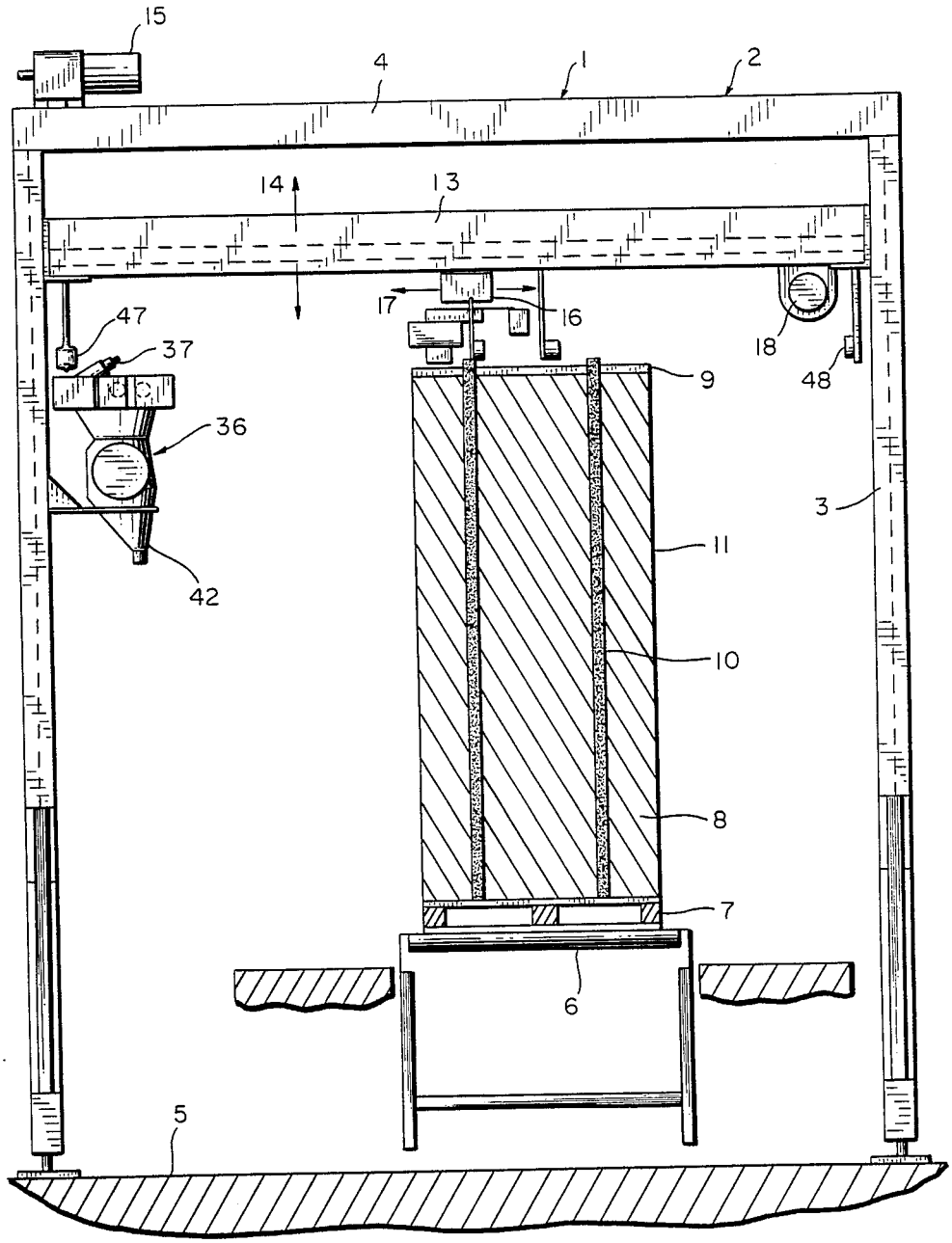
FIG. 1 schematically shows a front view of a first embodiment of a device according to the invention.
Figure 2:
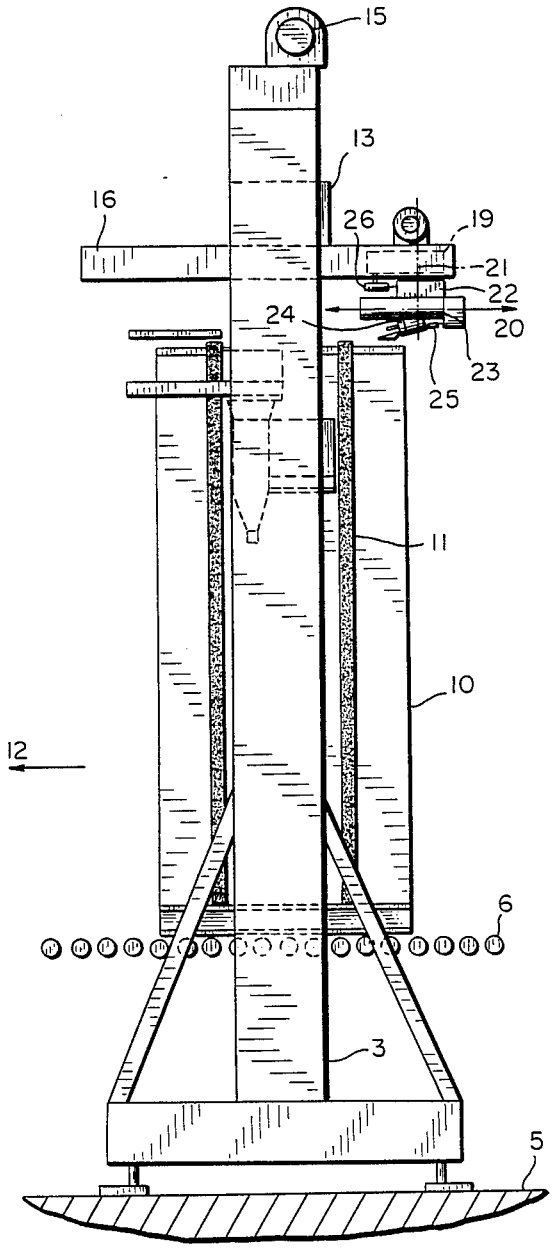
FIG. 2 shows a side view of the device of FIG. 1.
Figure 3:
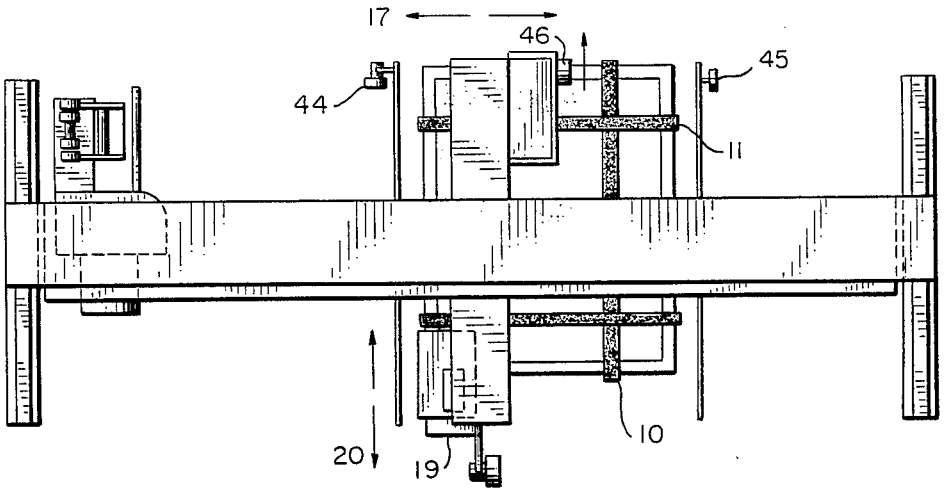
FIG. 3 shows a plan view of the device of FIGS. 1 and 2.

DESCRIPTION OF THE PREFERRED EMBODIMENT:

FIGS. 1, 2 and 3 show various views of a first form of the device 1, being composed of a framework 2, formed by vertical legs 3, and a horizontal beam 4. As in particular appears from FIG. 2, the legs 3 are mounted on the floor 5 and can be connected to the floor, if wanted.

The framework 2 is placed over a roller track 6 serving for supplying a pallet 7 to the device. A load 8 on said pallet is provided with a frame 9. Strapping bands 10 and 11 are placed around the pallet 7 and frame 9. The strapping bands 10 extend over the front and rear side of the pallet, as seen in the supply direction indicated by the arrow 12 in FIG. 2. The strapping bands 11 extend over the side walls of the pallet so that they are perpendicular to the strapping bands 10 as seen on the top surface of the pallet (FIG. 3).

Between the vertical legs 3 of the framework 2 a first support beam 13 is mounted such that it is movable upwardly and downwardly in the direction of the arrow 14, indicated in FIG. 1. This movement can take place by means of the motor 15 and by means which are not further indicated, but, e.g., can be formed by a chain or the like.

From the support element 19 a shaft 21 extends downwardly and on this shaft a support plate 22 is rotatably mounted, said support plate 22 being provided with a shaft 23 to which the clamping-cutting-means 24 is rotatably mounted. The clamping-cutting-means 24 is controlled by a cylinder 25 connected with the support plate 22.

The rotation of the support plate 22 to two different mutually perpendicular positions takes place by means of a cylinder-piston arrangement 26, the cylinder of which is connected to the support element 19 and the piston rod to the plate 22. By rotating the support plate 22 over 90°, the clamping-cutting-means 24 can act upon the strapping bands 10 as well as upon the strapping bands 11, as seen in the top view shown in FIG. 3.

Figure 4:
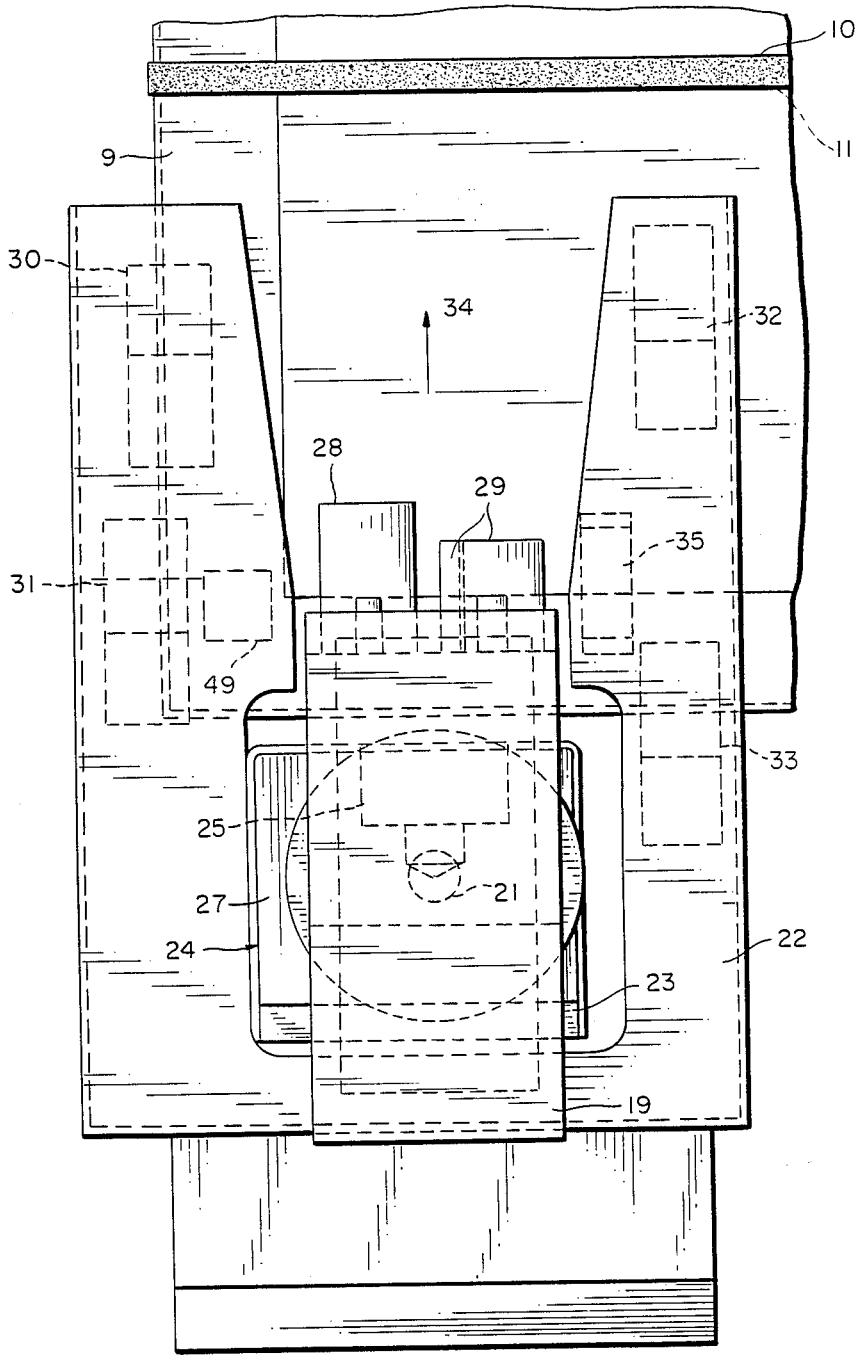
FIG. 4 shows a plan view of a clamping-cutting-means as applied in the device according to FIGS. 1–3.

FIG. 4 shows a top view of the support element 19 and shaft 21 with the support plate 22 rotatably mounted on it. The support plate 22 carries the shaft 23 on which the clamping-cutting-means 24 is rotatably mounted. This clamping-cutting-means 24 comprises a frame 27 carrying a set of clamping jaws 28 and a set of cutting jaws 29. One jaw of each set of jaws can be movable with respect to the other for clamping and cutting, respectively, a band 10 or 11, said bands being indicated in FIG. 4.

FIG. 4 also shows a section of the frame 9 which is positioned on the load 8 on the pallet 7. The strapping band 10 or 11 serves for obtaining a firm connection between the frame 9 and the pallet 7.

For controlling the movement of the clamping-cutting-means 24, the support plate 22 is provided with a number of photo-electric cells 30–33. The photo-electric cells 30 and 31 are operatively connected for guiding the clamping-cutting-means 24 along the related edge of the frame 9 by moving said means 24 in the direction of the arrow 34. The photo-electric cells 32 and 33 can observe when the clamping-cutting-means 24 is coming to lie above the pallet or when it leaves the pallet, respectively.

Further, a photo-electric cell 35 is present which can observe when a strapping band is coming to lie between the clamping jaws 28.

Figure 5:
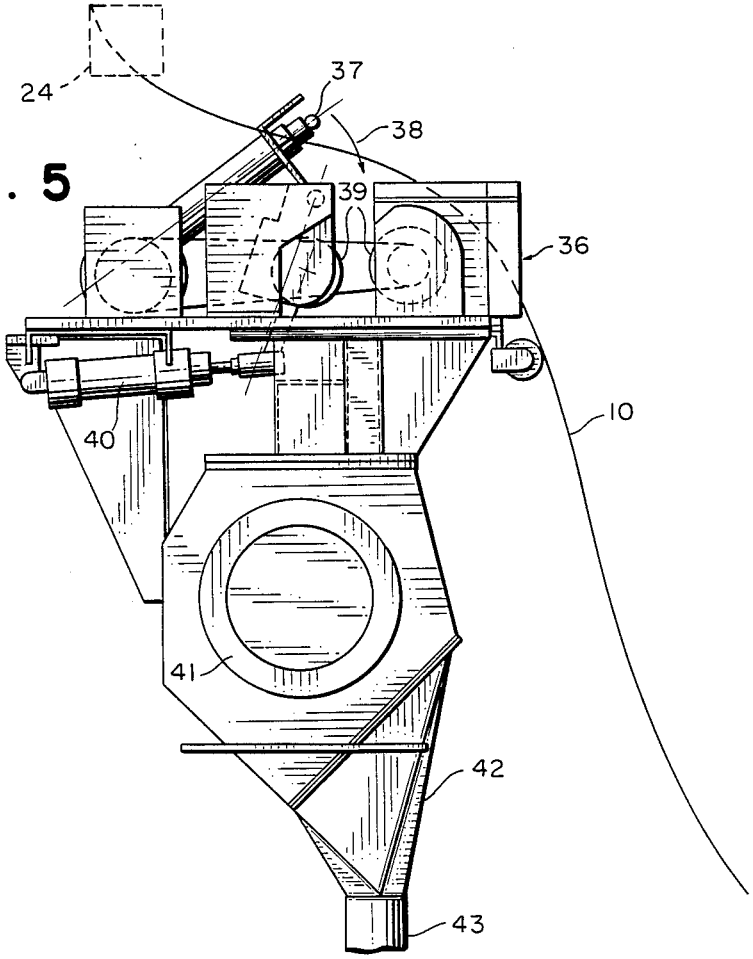
FIG. 5 shows a side view of a band receiving station with a shredder employed in the device according to FIGS. 1–3.

FIG. 5 shows the shredder device 36, from which only the most important parts are indicated and described below. Primarily, this is the retracting pin 37 below which a strapping band 10, being cut off, is brought by means of the clamping-cutting-means 24. The pin 37 is pivotally mounted so that it can be moved in the direction of the arrow 38 and can pass between two rolls 39 which are spaced from each other but are pressed towards each other when the band 10 has passed, as by means of the cylinder 40 activated by pressurized medium. Then the band 10 is taken along by the rotating rolls 39 and is supplied to the shredder 41 which is positioned inside the device 36. The shredded material is removed by means of the hopper 42 to which a hose 43 can be connected leading to a bag or the like (not shown). It is clear that a bag can also be directly connected to the hopper 42.

The retracting pin 37 can be moved out of the space below the rolls 39, e.g., by first moving it in a longitudinal direction and by afterwards pivoting back the pin to the position shown in FIG. 5.

The operation of the device according to the invention is as follows. In the "not activated" position of the device, the first support beam 13 is present in its highest position with the clamping-cutting-means 24 between the shredder device 36 and the track of a pallet 7. A pallet 7 to be handled is caused to move over the roller track 6 until it is below the device 1 and is caused to be positioned approximately in the desired place by means of the photo-electric cell 44 (FIG. 3) cooperating with the reflector 45, and is brought into its place exactly by means of the photo-electric cell 46. The photo-electric cell 44 is mounted to the track 6.

The first support beam 13 now is brought downwardly and is stopped by means of a photo-electric cell 47 (FIG. 1), cooperating with the reflector 48. The clamping-cutting-means 24 is then brought towards the pallet 7 and stopped above the edge of the pallet by means of a photo-electrica cell in such a way that it is positioned in longitudinal direction. Then the means 24 is moved rearwardly until the beginning of the pallet. As soon as a photo-electric cell is no longer observing the pallet, the means 24 will stop and will move again forward until the photo-electric cell is covered again. Now the means 24 stands still at the beginning of the search position.

The support beam 13 is moved somewhat downwardly until a guiding roll 49 (FIG. 4) mounted to the clamping-cutting-means 24 engages the frame 9, by which the means 24 is somewhat rotated in respect of the plate 22. By this rotation, a proximity switch is activated by which the movement of the support beam 13 will be stopped.

Now, the lowest clamping jaw 28 will be present inside the edge of the frame 9. The clamping-cutting-means 24 is moved forwardly along the frame 9, controlled by means of the photo-electric cells 30 and 31 mentioned above (FIG. 4), and will stop as soon as the related clamping jaw 28 is shifted below the first strapping band 10, which can be observed by means of the photo-electric cell 35. By means of the cylinder 25, the clamping-cutting-means 24 is then somewhat lifted and moved from the edge to the center of the pallet where the tension in the band is less than near the edge. Now the clamping jaws 28 are closed so that the band 10 is firmly clamped and then is cut off by means of the cutting jaws 29.

The first support beam 13 is now moved upwardly so that the clamping-cutting-means 24 is free to move above the pallet. The means 24, together with the clamped end of the strapping band 10 is then moved to the shredder device 36, bringing the band 10 near the retracting pin 37. In the way as described above, the band is passed between the rolls 39 after which the one roll 39 is moved to the other and the band is supplied to the shredder 41 by means of the rolls.

After the delivery of the band 10 to the shredder device 36, the clamping-cutting-means 24 is moved again to its initial position to search for the second strapping band. When the related bands 10 are removed, the clamping-cutting-means 24 is rotated over 90° by means of the cylinder 26 so that the bands 11 can be searched for.

It is obvious that depending upon the direction of the bands 10 and 11, the support element 19 will be moved along the support beam 16, or the support beam 16 will be moved along the support beam 13. In FIG. 2, the support plate 22 is rotated to such a position, with respect to the support element 19, that the clamping-cutting-means 24 is suitable to seize and cut the bands 11. In this case, the support element 19 is moved along the support beam 16.

Figure 6:
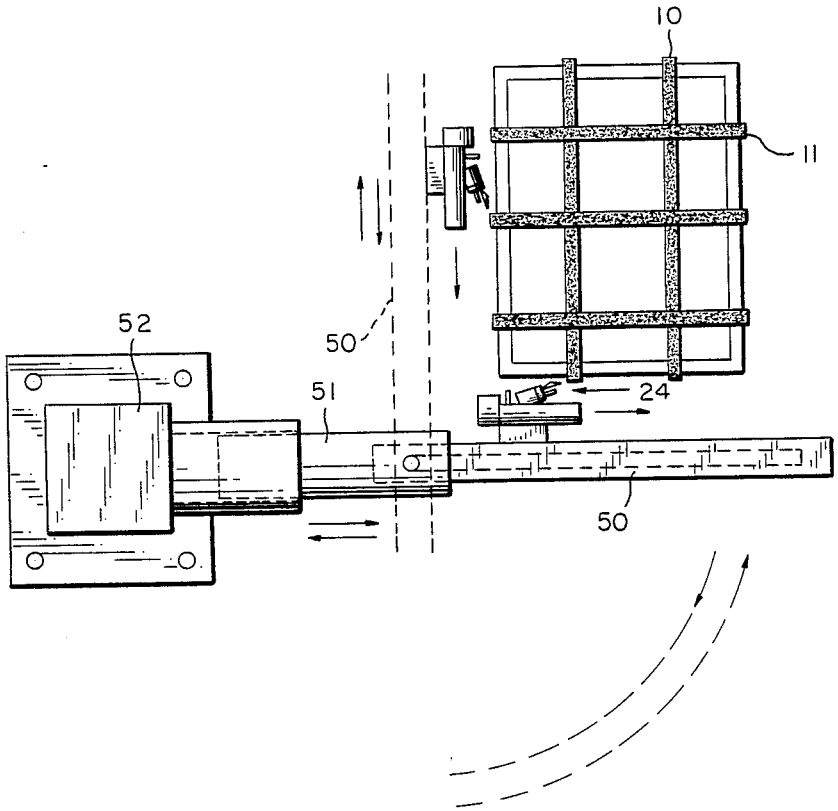
FIG. 6 schematically shows a top view of another embodiment of the device according to the invention.

FIG. 6 shows an alternative embodiment in which the clamping-cutting-means 24 does not act upon the strapping bands 10 and 11 at that place where they extend over the top surface of the loaded pallet, but where they extend along the vertical walls of the loaded pallet. To that end, the clamping-cutting-means 24 can be movably mounted on a support beam 50, which, e.g., can be positioned in two mutually perpendicular positions in veiw of the fact that it is pivotally mounted to a support 51 which is telescopically supported by means of the column 52.

Principally, the working of the device shown in FIG. 6 corresponds with that of the device shown in FIGS. 1–4, and described above. It will be obvious that it is also possible to seize the strapping bands at other places, such as at the bottom of the pallet. Also, more than one clamping-cutting-means might be used so that no pivoting of the clamping-cutting-means is necessary in case of the embodiment according to FIGS. 1–3. All these possiblities, however, are within the reach of an expert and so need no further elucidation.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

I claim:

1. A device for cutting and removal of the strapping bands from an object having at least one wall, said device comprising:

a framework adapted to be placed over a conveying track for supplying the object to the device;

support means carried by the framework and movable with respect thereto;

at least one clamping-cutting means carried by said support means for gathering, cutting and removal of said strapping bands, said clamping-cutting means having clamping means for clamping a band to be cut and cutting means for cutting the clamped band, and said clamping-cutting means being movable with said support means so that said clamping-cutting means may be brought into operative relationship with strapping bands wrapped around said object for gathering, cutting and removal of said strapping bands;

means on said clamping-cutting means to search for and sense the location of strapping bands lying against said object and to position the clamping-cutting means for clamping and cutting a band one located;

a band-receiving station fixedly positioned in said framework and having means for receiving the cut-off end of a strapping band clamped by said clamping means; and said clamping means being movable away from the object toward the band-receiving station to convey the cut-off end of the band to said band-receiving station after the band is cut, whereby said band is gathered and removed.

2. A device as claimed in claim 1, wherein:

said support means, and said clamping-cutting means carried thereby, are movable in two different angularly disposed planes for positioning the clamping-cutting means in operative relationship with strapping bands placed on said object in at least two different angularly disposed planes.

3. A device as claimed in claim 1, wherein:

said support means includes a first horizontal support beam extending transversely to the supply direction of the object, and a second horizontal support beam movable along the first support beam, said second support beam extending in a direction parallel to the supply direction of the object; and said support means including a support element on which the clamping-cutting means is carried, said support element being movable along the second support beam.

4. A device as claimed in claim 1, wherein:

said support means includes a first horizontal support beam extending transversely to the supply direction of the object, and a second horizontal support beam movable along the first support beam; and said support means including a support element on which the clamping-cutting means is carried, said support element being movable along the second support beam.

5. A device as claimed in claim 1, wherein:

the clamping-cutting-means comprises a set of clamping jaws which can seize a strapping band, and a set of cutting jaws which can sever the strpping band beside the portion which is clamped by the clamping jaws; and means to activate the clamping jaws and cutting jaws in sequence one after the other.

6. A device as claimed in claim 5, wherein: said search means includes photo-electric cells connected to control the clamping-cutting-means, including cells to detect when a strapping band is coming to lie between the clamping jaws and operative to energize the clamping jaws and cutting jaws to clamp and thereafter cut off a strapping band.

7. A device as claimed in claim 1, wherein:

the clamping-cutting-means is provided with a guide wheel which can cooperate with a part of the object.

8. A device as claimed in claim 1, wherein:

the band receiving station comprises two spaced apart rolls and a retracting pin, said retracting pin being engageable with a cut strapping band which is clamped by said clamping jaws to bring the cut band between the two rolls, and said rolls being pressed toward each other after the band has passed to feed the band into a shredder.

9. A device as claimed in claim 8, wherein:

cylinders activated by pressurized medium are connected to operate the clamping and cutting jaws, the retracting pin and the rolls, said cylinders being controlled by a relay.

10. A device as claimed in claim 8, wherein:

cylinders activated by pressurized medium are connected to operate the clamping and cutting jaws, the retracting pin and the rolls, said cylinders being controlled by a printed logic circuit.

11. a device for cutting and removal of the strapping bands from an object having at least two walls, said device comprising:

a framework adapted to be placed over a conveying tract for supplying the object to the device;

support means carried by the framework and movable with respect thereto in at least two different angularly disposed planes; and at least one clamping-cutting means carried by the support means for gathering, cutting and removal of said strapping bands, said clamping-cutting means being movable with said support means for movement of the clamping-cutting means in two different angularly disposed planes, whereby the clamping-cutting means may be moved to gather, cut and remove strapping bands placed on both or either of said at least two walls of the object.

12. A device as claimed in claim 11, wherein:

the clamping-cutting means is rotatably connected to the support means; and said support means is movable in three mutually perpendicular directions, two of which lie in the same plane as the plane in which the clamping-cutting means is rotatable.

13. A device as claimed in claim 12, wherein:

said support means includes a support element, said clamping-cutting means being carried on said support element.

14. A device as claimed in claim 13, wherein:

the support element includes means for bringing the clamping-cutting-means into two positions which are turned 90° with respect to one another.

* * * * *